US005081726A

United States Patent [19]

McCourt

[11] Patent Number: 5,081,726

[45] Date of Patent: Jan. 21, 1992

[54] WATER BED MATTRESS COVER AND METHOD OF APPLYING

[76] Inventor: Daniel M. McCourt, E2281 King Rd., Waupaca, Wis. 54981

[21] Appl. No.: 325,246

[22] Filed: Mar. 17, 1989

[51] Int. Cl.[5] ..... A47C 21/02

[52] U.S. Cl. ..... 5/451; 5/496; 24/72.5

[58] Field of Search ..... 5/451, 508, 496, 498, 5/450, 449, 452; 24/72.5

[56] References Cited

U.S. PATENT DOCUMENTS

| | | | |
|---|---|---|---|
| 4,521,970 | 6/1985 | Jester | 5/508 |
| 4,660,240 | 4/1987 | Hutton et al. | 5/451 |
| 4,683,602 | 8/1987 | Bissel | 5/451 |
| 4,782,543 | 11/1988 | Hutton et al. | 5/508 |

*Primary Examiner*—Alexander Grosz

*Attorney, Agent, or Firm*—Andrus, Sceales, Starke & Sawall

[57] ABSTRACT

A water bed has an open top support with a water filled mattress. A mattress cover of a suitable soft cloth extends partially over the sides of the water bed mattress. Releasable couplers are secured to the spaced locations about the mattress and preferably at the four corners. Each coupler includes a coupling ring attached to the cover by an elastic strap sewed directly to the underside of the cover. The ring is slightly above the base wall. A diamond-shaped bracket formed of a thin, round and plastic covered metal rod is slipped between the mattress and the base wall. A small hook is integrally formed of the one apex of the bracket. The bracket is located with the coupling hook immediately adjacent the corner of the mattress. The user pushes inwardly on the mattress corner to clearly expose the ring and hook. The ring is then pulled to the hook and conveniently, readily and quickly applied. The hook is also shown secured to the frame by a connected screw.

7 Claims, 1 Drawing Sheet

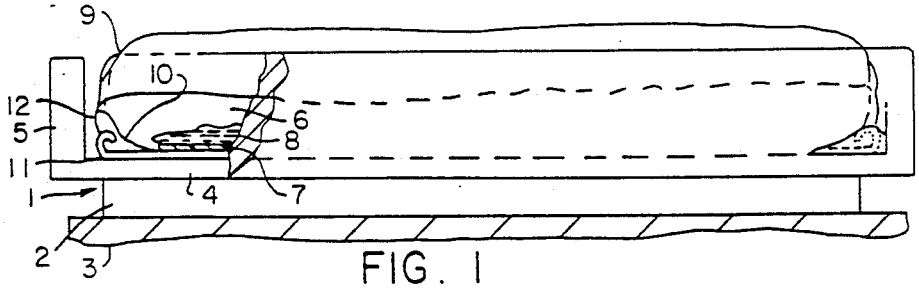
FIG. 1
FIG. 2
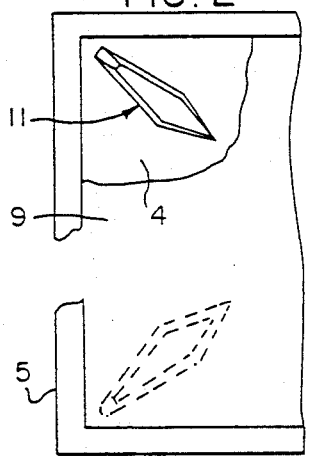
FIG. 3
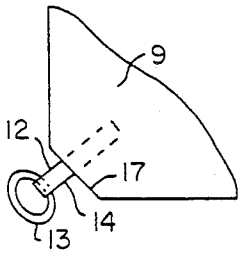
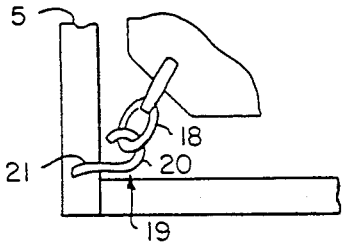
FIG. 6
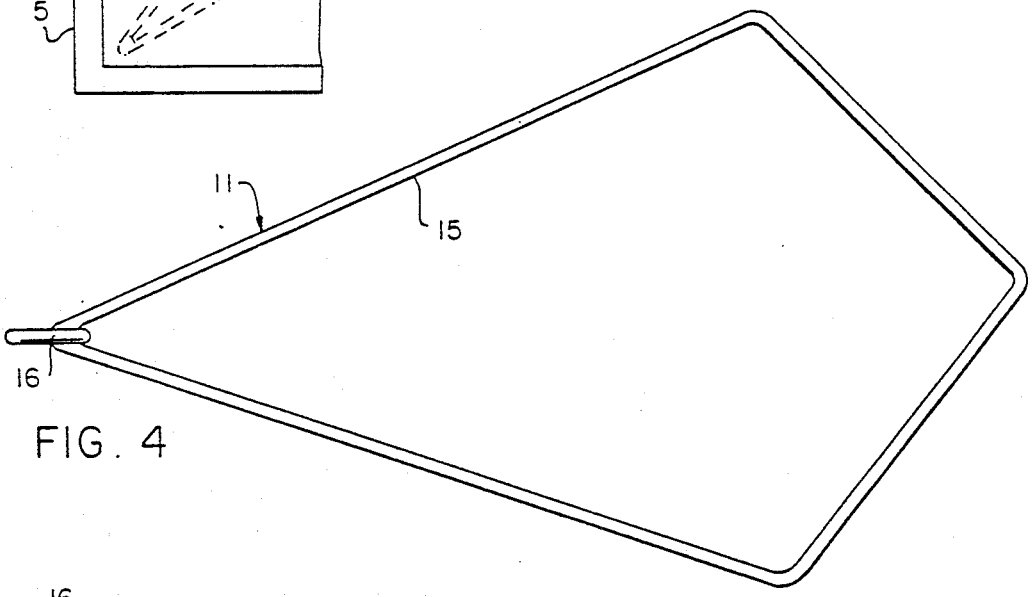
FIG. 4
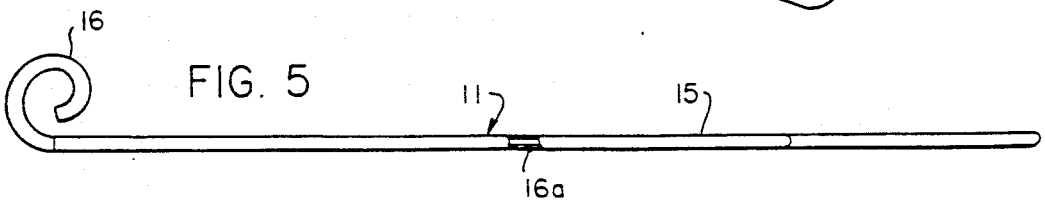
FIG. 5

WATER BED MATTRESS COVER AND METHOD OF APPLYING

BACKGROUND OF THE PRESENT INVENTION

The present invention relates to water bed mattress structure and particularly to a removable mattress cover having simple, effective and reliable means for attachment and release of the cover structure or element.

Water beds have gained wide popularity. Generally, a water bed includes a supporting frame structure. A water-filled mattress consists of an outer flexible shell which may have a plurality of subchambers or compartments. The shell is of course totally fluid impervious and when filled with water provides a water mattress which totally and completely conforms to the shape of the sleeper's body. The water-filled mattress provides an effective total support for the body with the elimination of stress points and the like. The shell surface of course is such that an outer soft cloth cover is generally provided to provide maximum comfort as well as permitting removal and cleaning of the sleeping surface.

Water beds, when filled with water, are relatively heavy. Attachment of a conventional mattress may require lifting or movement of the mattress to tuck the cover in place. The weight, bulk and general instability of the mattress when lifted at one location can create significant problems and at best is inconvenient. There is therefore a very significant need for a water mattress cover which can be conveniently, quickly and reliably applied to the water bed mattress, as well as removed for cleaning and the like.

SUMMARY OF THE PRESENT INVENTION

The present invention is particularly directed to a water bed apparatus including a supporting structure having a separate mattress cover attachment unit or elements in combination with a mattress cover adapted to fit over the water bed mattress and having means for a releasable coupling to the bed mounted couplings. The bed mounted couplings can be fixedly secured to appropriate parts of the bed support structure. In a preferred construction, the bed-mounted couplings include thin extended supports which can be readily slipped under the water-filled bed mattress and held against a base structure of the water bed support structure with a releasable coupling element exposed at the corner of the mattress. The cover itself is any suitable soft cloth, or other suitable material having portions adapted to extend partially over the sidewalls of the water bed mattress. Releasable coupling elements are secured in spaced locations about the mattress and preferably at the four corners and located for convenient, ready and releasable interconnection with the coupling elements on the bed mounted coupling elements. The inventor has found that this provides a highly satisfactory but simple, reliable and low cost mattress cover for water bed structures.

In a particularly practical construction, the sheet is formed with the four corners provided with the coupling elements. The coupling elements are attached to the sheet structure by an elastic member which is sewed directly to the underside of the corner cover unit. The sheet is designed to drape over the mattress with the corner portion projecting downwardly over the vertical sidewall of the mattress. The coupling member is a simple plastic ring or the like which is spaced slightly upwardly from the underside of the mattress in the normal unstressed state of the elastic band. The bed mounted coupling member includes a generally diamond shaped bracket formed of a thin round metal, plastic or other suitable material and having a smooth and continuous surface. The diamond configuration provides tapered sides generally corresponding to the tapered sidewall configuration of the water bed mattress. The one corner of the diamond shaped bracket includes a small hook fixed to the bracket. The bracket is readily slipped underneath the mattress without lifting of the mattress as such. The bracket is located with the coupling hook immediately adjacent the corner portion of the water bed mattress. To apply the cover, the user pushes inwardly on the corner of the mattress deflecting the mattress inwardly to clearly expose the hook. The ring member is then conveniently, readily and quickly applied. The mattress establishes a firm reliable interconnection of the bracket in place.

The present invention thus provides a very simple but highly effective method and apparatus for firmly securing a water bed mattress cover to the water bed mattress. The mattress cover can readily be applied and removed without any excess physical exertion and thus is particularly adapted to practical implementation in the home as well as in commercial establishments.

BRIEF DESCRIPTION OF THE DRAWING

The drawing furnished herewith illustrates the best mode presently contemplated for carrying out the invention and is described hereinafter.

In the drawing:

FIG. 1 is a side elevational view of a water bed structure with parts broken away and sectioned to illustrate certain detail of the illustrated embodiment of the invention;

FIG. 2 is a fragmentary top plan view of the water bed structure shown in FIG. 1;

FIG. 3 is an enlarged fragmentary view of a mattress cover;

FIG. 4 is a plan view of a bracket shown in FIGS. 1–3;

FIG. 5 a side view of FIG. 4; and

FIG. 6 is a fragmentary illustration of a water bed illustrating an alternate coupling system for interconnecting of a water bed mattress cover to a water bed structure in accordance with the present invention.

DESCRIPTION OF THE ILLUSTRATED EMBODIMENT

Referring to the drawing and particularly to FIGS. 1 and 2, a water bed is illustrated including a base support or frame 1 having a continuous base resting on a supporting floor structure 3. A flat bottom wall 4 spans the base 2. An upstanding wall 5 projects upwardly above the base wall 4 and defines a rectangular recess within which a water mattress 6 is supported and confined. The water mattress 6 substantially fills the recess defined by the flat base wall 4 and the upstanding sidewalls 5. The water mattress is formed in accordance with a conventional construction with an outer impervious shell 7 and filled with water 8 to define the total support surface for the sleeper. The mattress may have a vertical depth of six inches or more. Although the water bed is shown as a simple rectangular frame structure, in actual practice the bed is normally provided with an appropriate head board or the like, not shown, and may of course be of any desired configuration. A mattress cover 9 overlies the upper surface of the water mattress 6 and in accordance with the teaching of the present invention extends downwardly over the sides of the mattress. Releasable securement or couplers 10 are provided at each corner of the bed 1 having a support mounted coupling unit 11 connected to the bed structure and a releasably connected cover-mounted coupling unit 12 connected to the overhanging corner portion of the mattress cover. The mattress cover 9 may be formed of any suitable soft cloth material, or other suitable material, and is generally formed as a single woven integral member having the integral corner portion projecting downwardly with the releasable coupling units 12 connected thereto. The coupling unit 12 is shown including a coupling element 13 in the form of a ring which is preferably connected to the mattress cover 9 by an elastic connector 14 to permit the convenient interconnection releasable connection and maintaining of the cover under tension on the upper surface of the water bed. In the illustrated embodiment of FIGS. 1–5, the bed mounted coupling unit 11 consists of a mounting bracket 15 of a relatively flat and thin construction which is readily disposed between the water bed mattress 6 and the bottom wall 4 by merely slipping of the bracket beneath the mattress. The outer end of the bracket 15 includes a hook 16 located at or slightly outwardly of the mattress. With the sidewall 6 about mattress, the corner of the mattress is pushed back and slipped into place. Thus, there is no necessity for significant raising or lifting of the mattress. The coupling ring 13 and hook 16 are thus readily accessible without the necessity of any significant physical labor or force.

In use, the mattress is pushed inwardly at the corner of the bed to expose the bed mounted hook 16 for convenient attachment and detachment of the mattress cover ring 13 for placement and removal of the cover 9 from the mattress 6 at the several locations, illustrated at the four corners of the mattress. Thus, the illustrated embodiment provides a very simple, reliable and effective concept and method for interconnecting of a water bed mattress to releasably enclose or cover a water bed mattress.

More particularly, in the illustrated embodiment of the invention, the mattress cover 9 is shown as a single layered fabric generally of a configuration corresponding to the outer configuration of the water mattress 6.

The edge portion of the mattress cover 9 extend partially downwardly over the sidewall of the mattress 6 terminating in upwardly spaced relation to the bottom wall 4. In the illustrated embodiment of the invention, the corner portions of cover 9 which extend downwardly over the corner portions of the water mattress 6 are cut off on a bias, as at 17. An elastic strap 14 is sewen to the edge of the cutoff corner 17 and projects outwardly therefrom with the coupling ring element 13 secured to the projecting elastic strap 14. In the illustrated embodiment of the invention, the elastic strap 14 is formed as a loop member with the ring inserted in the outer end of the loop prior to sewing to the cover. The ring thereby located outwardly from the cover a slight distance by the elastic strap and freely accessible to the user.

The bed mounted unit 11 in the illustrated embodiment of the invention includes the bracket 15 formed in a more or less diamond-shaped configuration. The bracket 15 is shown formed from a thin rod-like member such as a metal member, although any other suitable rigid and relatively smooth surface material can be used. The rod is shaped into the diamond configuration with the one end bent upwardly and about to form the attachment hook 16. The diamondshaped bracket with hook 16 is preferably covered with a suitable plastic, as at 16*a*, such as a ring to create a smooth continuous surface and eliminate any possible damage to the mattress shell.

The bracket 15 is shown inserted underneath the mattress with the principle axis extending along the diagonal of the bed frame 1. The hook member 16 is secured to the outer apex or corner of the diamond shape base and projects upwardly therefrom. The hook may of course be formed separately and connected to the base. Thus, a simple plastic hook having a shank may be secured to the base. The hook 16 projects upwardly and terminates in a downwardly curved hook portion and opening with the mattress cover 9 lying on top of the mattress 6 and with the edge portion overlapping the side edge of the mattress, the user merely pushes inwardly on the edge or corner of the mattress 6 exposing the hook 16. The cover ring 13 is pulled downwardly and looped beneath the hook, and upon release the elastic strap 14 holds the cover 9 stretched over the mattress 6.

The bracket and the hook member as well as the other elements of the coupling assembly are all formed with very smooth surfaces and without sharp edges, corners or the like. There is therefore absolutely no danger of the coupling assembly and its mounting tending to wear and eventually create a hole in the water mattress.

The illustrated embodiment of the invention has been found to provide a very practical solution to the difficulties heretofore presented in adequately covering water mattresses.

The bracket and the cover coupling elements are readily available and readily produced from conventional and readily available materials. Further, the attachment of the coupling members to the cover is a standard procedure while the assembly and interconnection of the bed mounted unit is simple, reliable and effective without damaging the structure, esthetically or structurally.

Although the illustrated cover provides a particularly practical and commercially satisfactory cover assembly, other systems can of course be used. For example, the bed mounted unit may employ a simple hook member having a mounting screw or a member for affixedly securing the coupling member directly to an element of the bed support, such as shown in FIG. 6, which is a fragmentary view of one corner of a mattress cover. In FIG. 6, the cover 9 is provided with a ring member 18 generally as in the first embodiment. A bedmounted hook unit 19 includes a small hook 20 adapted to hook over the ring. The hook 20 is secured by an integral screw 21 which is screwed into the bed sidewall 15. The assembly essentially is similar to that previously described.

Various other modifications can of course be employed in accordance with the teaching of the present invention which is particularly directed to the provision of a releasable coupling assembly connected respectfully to the mattress cover and the bed support structure to firmly and reliably attach the cover.

Various modes of carrying out the invention are contemplated as being within the scope of the following claims particularly pointing out and distinctly claiming the subject matter which is regarded as the invention.

I claim:

1. In combination, a water bed having a support structure including a base wall and an encircling sidewall, a water filled rectangular mattress located on said base wall and within said sidewall and confined by said sidewall and having four corners, a cover overlying said mattress and having outer edge portions partially overlapping the sidewalls of said mattress, cover couplers located at each corner of said mattress, each of said couplers including a first coupling unit secured to said support structure and a second coupling unit secured to said outer edge portion, said first and second coupling units being releasably connected and establishing releasable fixing of said cover over said mattress, each of said first coupling units including a flat bracket in a diamond-shaped configuration, said bracket being located with an apex of the bracket aligned with the corner of the mattress, and having a sale hook member secured to the apex of the bracket, said bracket includes a single integral rod, said hook being integral with and an extension of said rod.

2. In the combination of claim 1, wherein said rod is covered with a plastic coating.

3. In the combination of claim 1, including an elastic member secured to one of said first and second coupling units and said elastic member having a releasable connector adapted to be interconnected to the second of said coupling units.

4. In combination, a water bed having a support structure including a base wall and an encircling sidewall, a water filled mattress located on said base wall and within said sidewall and confined by said sidewall, a cover overlying said mattress and having outer edge portions partially overlapping the sidewalls of said mattress, a plurality of cover couplers spaced about said mattress, each of said couplers including a first coupling unit secured to said support structure and a second coupling unit secured to said outer edge portion, said coupling units being releasably connected and establishing releasable fixing of said cover over said mattress, wherein said first coupling unit includes a bracket formed from a thin rod bent into a substantially closed encircling configuration and including an offset and forming a sale releasable hook-like coupling element.

5. In the combination of claim 4, wherein said rod is a smooth metal rod, and said rod is covered with a plastic coating.

6. A hold down coupling device for holding of a cover over a waterbed mattress resting on a base wall and with the cover extended downwardly over the sides of the waterbed mattress and wherein said hold down apparatus comprises an extended thin rod element having a sale connector extended from the rod element, said thin rod element defining a complete encircling closure in a common plane and extending laterally from said connector, said connector being a hook-like element immediately adjacent the rod element, and a flexible connecting element interconnected to said connector and to the adjacent cover to establish a releasable resilient interconnection of the cover over the mattress.

7. The device of claim 6, wherein said rod element is formed of a metal and includes an outer protective covering establishing a continuously smooth surface for protecting of the mattress from any sharp destructive edges.

* * * * *

UNITED STATES PATENT AND TRADEMARK OFFICE

CERTIFICATE OF CORRECTION

PATENT NO. : 5,081,726

DATED : January 21, 1992

INVENTOR(S) : DANIEL M. McCOURT

It is certified that error appears in the above-identified patent and that said Letters Patent is hereby corrected as shown below:

ON THE TITLE PAGE

Item [56] References Cited, add --4,901,388, 2/1990, Irwin--; Claim 1, Col. 5, Line 20, delete "sale" and substitute therefor -- sole --; Claim 4, Col. 6, Line 10, delete "and" and substitute therefor -- end --; Claim 4, Col. 6, Line 11, delete "sale" and substitute therefor -- sole --; Claim 6, Col. 6, Line 20, delete "sale" and substitute therefor -- sole --;

Signed and Sealed this

Twenty-ninth Day of June, 1993

*Attest:*

Michael K. Kirk

MICHAEL K. KIRK

*Attesting Officer*

*Acting Commissioner of Patents and Trademarks*